United States Patent [19]

Wendt

[11] 4,231,205

[45] Nov. 4, 1980

[54] STEEL EDGE GYPSUM WALL PANEL

[75] Inventor: Alan C. Wendt, Barrington, Ill.

[73] Assignee: United States Gypsum Company, Chicago, Ill.

[21] Appl. No.: 970,073

[22] Filed: Dec. 18, 1978

[51] Int. Cl.[3] ..... E04B 2/08

[52] U.S. Cl. ..... 52/481; 52/762

[58] Field of Search ..... 52/481, 488, 489, 601, 52/744, 145, 732, 238, 349, 354, 357–359, 774–782, 762

[56] References Cited

U.S. PATENT DOCUMENTS

| | | | |
|---|---|---|---|
| 1,789,827 | 1/1931 | McKay | 52/481 |
| 2,018,911 | 10/1935 | Brill et al. | 52/601 |
| 2,151,148 | 3/1939 | Plumb | 52/601 |
| 2,271,929 | 2/1942 | Venzie | 52/601 |
| 2,710,081 | 6/1955 | Fink | 52/238 |
| 3,277,622 | 10/1966 | Jensen | 52/489 |
| 3,313,076 | 4/1967 | MacDonald | 52/144 |
| 3,695,395 | 10/1972 | Ollinger et al. | 52/145 |
| 3,841,048 | 10/1974 | Jahn | 52/732 |

*Primary Examiner*—James L. Ridgill, Jr.

*Attorney, Agent, or Firm*—Glenn W. Ohlson; Samuel Kurlandsky; Robert H. Robinson

[57] ABSTRACT

A steel edged gypsum wall panel engageable by flanged studs is disclosed. The panel having a body portion being from about 5/16 inches to about ¾ inches thick with front and back faces and having opposite marginal edges. Said steel edging having a chan- nel shape and comprising a front flange, a back flange, and a web portion integrally connecting said flanges and adapted to contact the marginal edges wherein said back flange terminates in a return flange providing an engageable slot therebetween.

27 Claims, 8 Drawing Figures

STEEL EDGE GYPSUM WALL PANEL

THE BACKGROUND OF THE INVENTION

1. Field of the Invention

The invention relates to steel edged gypsum wall panels engageable by flanged studs for wall partition construction utilizing two parallel rows of gypsum wall panels.

2. Description of the Prior Art

Hollow wall building construction has wide industrial and residential acceptance especially utilizing gypsum wall paneling. In many such wall systems flanged studs are supportively concealed within slots, or kerfs, which are provided along marginal edges of the panels. Some systems provide removable stud portions at the kerf engaging edge allowing accessibility to the hollow space. Other wall constructions provide clips which engage the marginal panel edge and resiliently snap engage a flanged stud.

Because of the strength required along the panel edges to prevent breakage during shipping, installation, and normal abuse, many attempts have been made to protect the edge. Some systems have eliminated the kerfed edge and provided a metal cladding at the exterior face of the panel which terminates in resiliently engaging snap-on portions. Although avoiding the problems with abuse and breakage at the corner, the system requires a costly stud having mating snap-on portions for the metal panel edging. It would be desirable to utilize conventional I-shaped metal studs and yet provide the panel protection which metal affords.

Other wall assemblies have provided a facing and edging formed from sheet metal for use with interlocking wall panels. In this type of system the panels engage one another intermediate the studs, and at stud locations would engage the stud. This interlocking feature is provided so that panels may be connected between large stud spacing without requiring intermediate studding.

A problem with many of the metal clad and metal edged panels is the inability of the design to provide flush or planar surfaces at the front and back faces. This becomes particularly significant during shipping and storage where panels are stacked one on top of another. Without this, the particular metal shaped edges are subject to damage and deformation which is unavoidable during normal loading and unloading procedures. It is therefore desired by the building industry that a steel edged gypsum panel be provided which can be stored, loaded and unloaded in a conventional stacking procedure without additional time consuming cautious handling procedures to avoid damage.

It is also desirable to have straight and parallel panel edges that allow tight and flush joints when installed at flanged metal studs. Further, it is desirable to provide a gypsum panel with greater resistance to impacts than with conventionally kerfed edge board. In providing this greater resistance it is also desirable that, because of the increased strength and protection inherent in metal edging, the thickness of the board may be reduced without sacrificing structural integrity.

3. Objects of the Invention

It is a primary object of this invention to provide a gypsum panel with steel edging channels that provide strength and protection at marginal edges.

It is an important object of this invention to provide steel edging channels engageable with conventional metal flanged studs widely utilized in kerfed edge wall partition construction.

It is a related object of this invention to provide a steel edged gypsum panel which has flush front and back faces permitting stacking of panels without damage.

It is an allied object of this invention to provide a steel edged gypsum panel which allows reduced panel thickness, in comparison with present saw kerfed gypsum panels, without sacrificing strength and stability.

It is also a related object of this invention to provide steel edged gypsum panels having a metal sheet covering the face of the panel to provide additional protection and utility as a writing or tackboard surface.

SUMMARY OF THE INVENTION

In attaining all of the foregoing objects, a steel edged gypsum wall panel being engageable by flanged studs is provided. The gypsum panel having a body portion being from about 5/16 inches to about $\frac{3}{4}$ inches thick with front and back faces, and having opposite marginal side edges. The steel edging having a channel shape and comprising a front flange, a back flange, and web portion integrally connecting said flanges and adapted to contact said marginal edge. The back flange terminates in a return flange providing an engageable slot therebetween.

The objects of the invention are further attained by a wall partition assembly herein disclosed. Said assembly comprising two parallel rows of gypsum wall panels including at least one panel having steel edging. The steel edged panel comprising a body portion and steel edging along opposite marginal side edges of the body portion. The assembly additionally provides a plurality of studs located at joints between adjacent panels. The studs comprise a body portion with opposite T-shaped engageable flanged edges wherein at least one stud engages the steel edged panel having an arm of the T supportively engaged within the flange-engageable slot.

The objects of the invention are further attained by providing a steel edged gypsum wall panel wherein the body portion is tapered adjacent marginal side edges on both front and back faces to provide reduced thickness along said opposite marginal edges. The steel edging channels cap said reduced marginal edges between front and back flanges and have a depth substantially equal to the thickness of the body portion. Thereby, the return flanges are substantially coplanar with the back face and said back flanges contact the tapered portions on the back face.

BRIEF DESCRIPTION OF THE DRAWINGS

The foregoing and other more specific objects of the invention are attained by the construction and arrangement illustrated in the accompanying drawings wherein.

DESCRIPTION OF THE PREFERRED EMBODIMENTS

Figure 1:
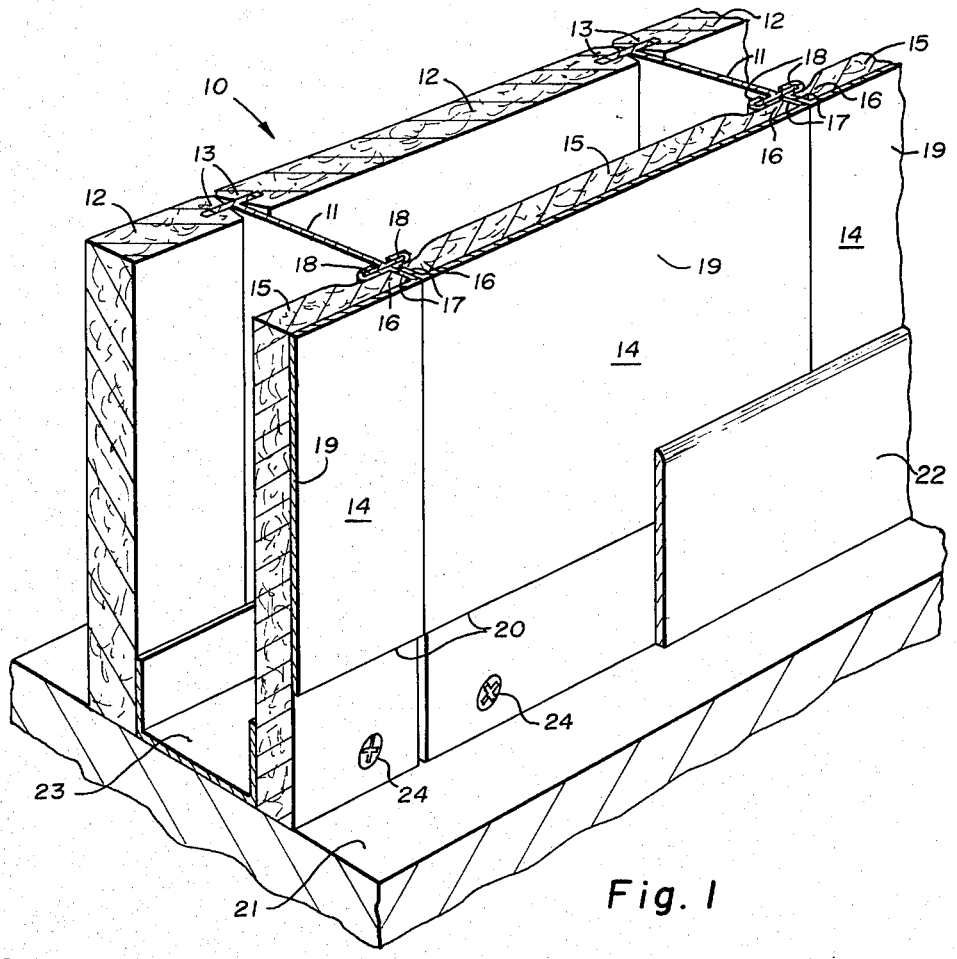
FIG. 1 is a perspective view of a wall partition assembly partially broken away showing the preferred embodiment for the steel edged panel in accordance with this invention utilized with conventional wall partition elements.

FIG. 1 shows, in perspective, a portion of a wall partition assembly 10 which provides a hollow wall construction. Flanged studs 11 are provided at spaced apart intervals for panel support. Conventional panels 12 are shown at one side of wall partition assembly 10 and are provided with conventional kerfed edges 13. Kerfed edges 13 are typically provided by saw cutting. The conventional panels 12 are shown as comprising gypsum. At the other side of wall partition assembly 10 are steel edged panels 14 in accordance with this invention.

Steel edged panels 14 have a body portion 15 with opposite marginal edges 16. The marginal edges 16 are capped by steel edging 17 which is preferably channel-shaped. Body portion 15 is comprised of gypsum and in the preferred embodiment has a thickness of about $\frac{5}{8}$ inches and width of 24 inches. The steel edging 17 has an engageable slot 18 for supportive engagement with the flanges of flange studs 11.

In the preferred embodiment shown in FIG. 1, a steel facing 19 extends across steel edge panel 14 integrally connecting the steel edging 17 at opposite marginal edges 16. Steel facing 19 has a bottom edge 20 which is desirably terminated at from about two inches to about six inches from floor 21. The termination of steel facing 19 at this distance from the floor 21 allows for trimming and necessary adjustments during installation caused by floor irregularities or the like. A base trim 22 is disclosed as a conventional member providing decorative appearance for the bottom portion of the wall and additionally concealing floor irregularities and fasteners.

Wall partition assembly 10 additionally comprises a conventional floor runner 23 for support of conventional panels 12 and steel edged panels 14. The base trim 22 is partially broken away to expose fasteners 24 which connect steel edged panels 14 to floor runner 23. Fasteners 24 are disclosed as being conventional self drilling and self tapping screws well known to the construction industry.

Figure 2:
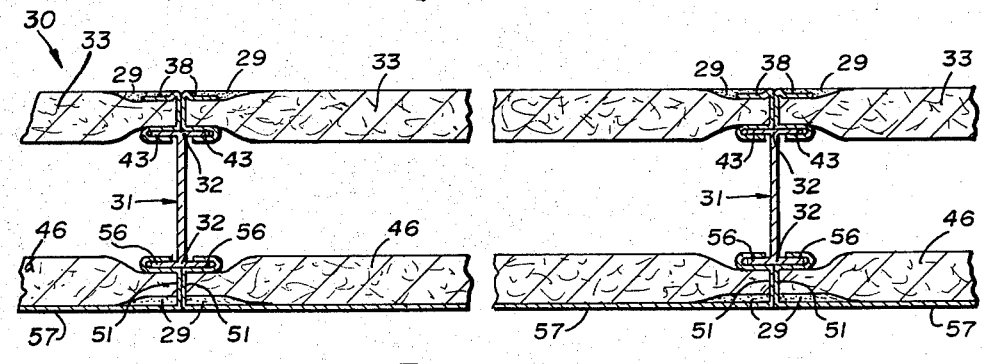
FIG. 2 is a cross-sectional view of a wall partition assembly utilizing the steel edged panel of this invention showing preferred alternative conformations in accordance with the invention.

FIG. 2 illustrates a wall partition assembly 30 in cross-sectional view. Steel edged panels 33 and 46 are disclosed as preferred alternative embodiments for the steel edged panel of this invention. Wall partition assembly 30 provides conventional flanged studs 31 having T-shaped engageable flanged edges 32.

Steel edged panels 33 comprise steel edges 38 with slots 43 therein. Slots 43 engage the T-shaped engageable flanged edges 32 of the studs 31 for support.

Steel edge panels 46 are similarly provided with steel edges 51 having slots 56 therein. Additionally, a steel facing 57 is provided which integrally connects steel edges 51 to provide a facing to the steel edged panel 46.

Figure 3:
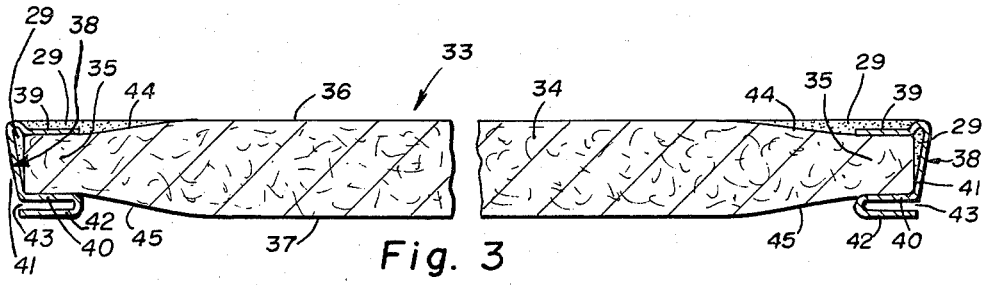
FIG. 3 is a cross-sectional view which shows the steel edged panel embodiment illustrated in FIG. 2 wherein no steel facing is provided.

Turning now to FIG. 3, the steel edged panel 33 of FIG. 2 is shown in greater detail. Body portion 34 has marginal edges 35, front face 36, and back face 37. At opposite marginal edges 35 channel shaped steel edges 38 are provided. The steel edges 38 have a front flange 39 and a back flange 40. Front flange 39 and back flange 40 are integrally connected by a web portion 41 which is adapted to contact the marginal edge 35. Back flange 40 terminates in a return flange 42 to provide a slot 43 therebetween. Slot 43 provides means for engagement with flanged stud 31 along the T-shaped engageable edges 32.

Body portion 34 is provided with taper 44 on the front face 36 extending along and adjacent the marginal edge 35. Additionally, taper 45 is provided on the back face 37 extending along and adjacent the marginal edge 35. Across the marginal edges 35 a reduced thickness of from about 80% to 95% of the body portion 34 is provided. Steel edging 38 caps the marginal edges 35. The overall width of the steel edging 38 is substantially equal to the thickness of the body portion 34. The front flanges 39 contact tapers 44, back flanges 40 contact tapers 45 and return flangees 42 are substantially coplanar with the back face 37.

Steel edged panel 33 is protected at the marginal edges 35 by the steel edging 38. Additionally, the depth of steel edging 38 is preferably no greater than the thickness of the body portion 34 to allow panels to be safely stacked flatly one on top of another without harmful effects caused by protuberances from a steel edging. The slot 43 provides sufficient depth for interconnection between the T-shaped engageable flanged edges 32 of stud 31. The slot 43 is adapted for conventional studding widely known to the hollow wall partition industry by providing engagement similar to conventionally kerfed edged gypsum wallboard. By utilizing the steel edging 38 however, the problems of maintaining tolerances and edge strength associated with saw cutting are eliminated. Moreover, the edge of the panel is protected from damage during storing, installing and shipping.

A bonding adhesive 29 is preferably utilized to secure the steel edging 38 to marginal edge 35. Additionally, bonding adhesive 29 is disposed along both tapered portions 44 of front face 36 sufficient to fill the tapers 44 and provide a smooth exterior substantially coplanar with front face 36. The bonding adhesive 29 is disclosed as preferably comprising a thermoplastic adhesive or joint compound widely known to the industry.

Figure 4:
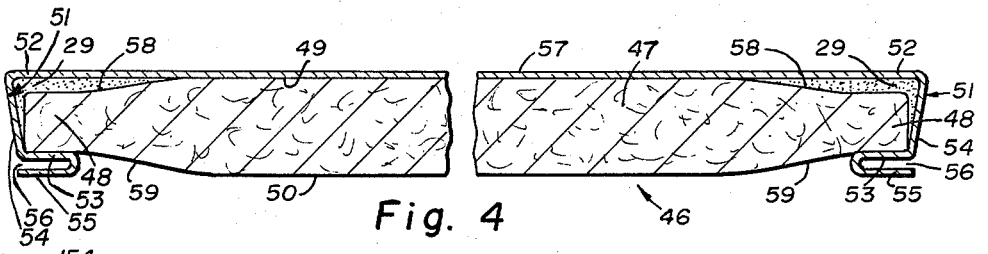
FIG. 4 is a cross-sectional view which shows the steel edged panel embodiment illustrated in FIG. 2 wherein the panel is provided with a steel facing.

FIG. 4 shows steel edged panel 46, as illustrated in FIG. 2, in a preferred alternative embodiment in accordance with this invention. Steel edged panel 46 has body portion 47 with marginal edges 48, front face 49, and back face 50. Steel edging 51 preferably has a channel shape and is provided at both opposite marginal edges 48.

Steel edging 51 comprises a front flange 52 and a back flange 53. The front flange 52 and back flange 53 are integrally connected by web portion 54 which is adapted to contact the marginal edges 48. Back flange 53 terminates in a return flange 55 which provides a slot 56 therebetween. The slot 56 is adapted to engage conventional flanged studs 31 along T-shaped engageable flanged edges 32. In this embodiment, a steel facing 57 integrally connects front flanges 52 and resides in substantially coplanar relationship to provide a generally flat facing to steel edges panel 46.

Taper 58 is provided on the front face 49 adjacent marginal edge 48. Also, taper 59 is provided on the back face 50 adjacent marginal edge 48. A reduced thickness of from about 80% to about 95% is thereby provided at marginal edges 48 in comparison with the thickness of body portion 47. The desired thickness of body portion 47 being about $\frac{5}{8}$ inches. The steel edging 51 caps the marginal edges 48. The depth of steel edging 51 is preferably no greater than the thickness of body portion 47 thereby facilitating stacking without damage from protruding portions.

In this embodiment, optionally, bonding adhesive 29 is provided between the steel edging 51 and marginal edge 48 and also optionally between the steel facing 57 and front face 49 to attain additional securement therebetween.

Figure 5:
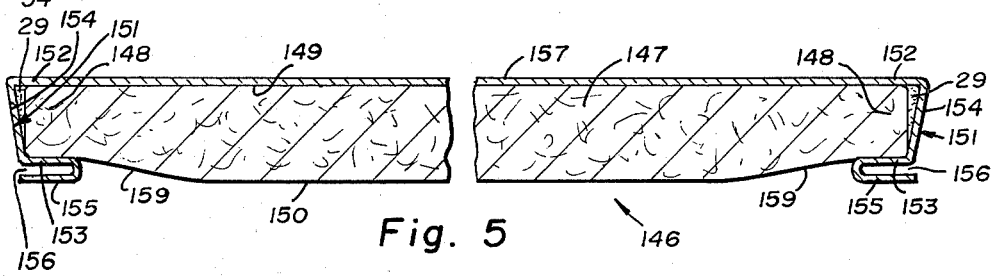
FIG. 5 is a cross-sectional view which shows an alternative embodiment for the steel edged panel illustrated in FIG. 2 which provides a steel facing.

FIG. 5 illustrates an alternative embodiment for steel edged panel 46 of FIG. 4 and is disclosed as being steel edged panel 146. Steel edged panel 146 is similarly constructed and is provided with a body portion 147 having opposite marginal edges 148, front face 149, and back face 150. Along opposite marginal edges 148 a steel edging 151 is provided and has a generally channel-shape. Steel edging 151 comprises a front flange 152 and a back flange 153 which are integrally connected by a web portion 154 which is adapted to contact marginal edges 148. Back flange 153 terminates in a return flange 155 to provide a slot 156 therebetween. Slot 156 is adapted to engage the T-shaped engageable flanged edges 32 of a conventional flanged stud 31. Steel facing 157 integrally connects front flanges 152 and is generally coplanar thereto. In this embodiment there is no taper on front face 149 but taper 159 is provided on the back face 153 adjacent both marginal edges 148. The depth of steel edge 151 is preferably no greater than the thickness of body portion 147 and desirably provides substantially uniform thickness for steel edged panel 146. The uniform thickness of steel edged panel 146 facilitates stacking and handling. Bonding adhesive 29 may optionally be provided between the steel edges 151 and marginal edges 148 and optionally also between the steel facing 157 and front face 149 for additional securement therebetween.

In all three FIGS. 3–5 the web portions of the steel edgings are preferably angled away from the panel edges inclining outwardly from the back face to front face. As seen by web portions 41, 54 and 154, a recess for bonding adhesive 29 is thereby created. Additionally, the angled web portions also ensure a snug contact between front faces of the panels and steel edging front flanges; and, snug contact between the front faces of the panels and steel facing, if provided.

Figure 6:
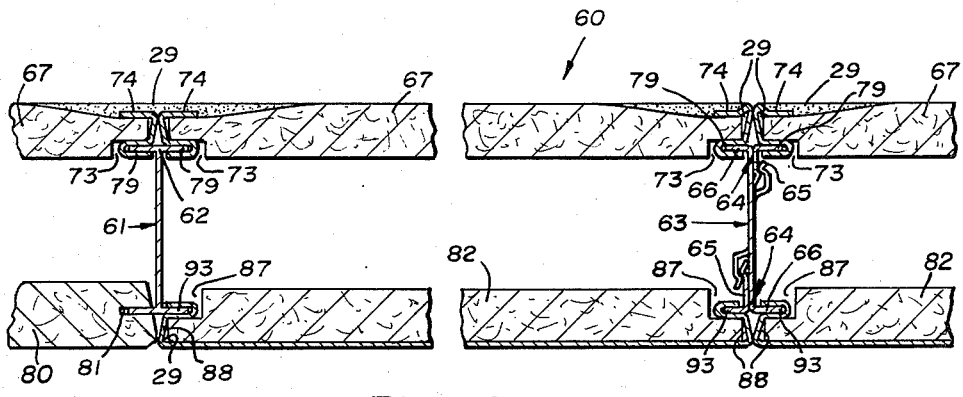
FIG. 6 is a cross-sectional view of a wall partition assembly in accordance with this invention utilizing the steel edged panel of this invention in preferred alternative conformations having notches on the back face.

Now referring to FIG. 6, wall partition assembly 60 is shown in cross-sectional view. This assembly provides a conventional flanged stud 61 having T-shaped engageable edges 62. Additionally, assembly 60 includes releasably locking stud 63 having T-shaped engageable edges 64. The difference with the releasing stud is that it incorporates a removable member 65 which resiliently engages a remaining edge portion 66 to provide the T-shape. In conformance with this invention steel edged panel 67 and steel edged panel 82 are provided. Conventional kerfed edge panel 80 is shown as being fully adaptable for use with the invention as disclosed.

As seen in FIG. 6, steel edged panels 67 are provided with a steel edging 74 having slots 79 engageable with the T-shaped engageable edges 62 of conventional studs 61 and releasable T-shaped engageable edges 64 of releasably locking stud 63.

FIG. 6 also depicts steel edged panel 82 having steel edging 88 with slots 93 engaged with the T-shaped engageable edges 62 of conventional flanged stud 61 and releasable T-shaped engageable edges 64 of releasably locking stud 63.

Figure 7:
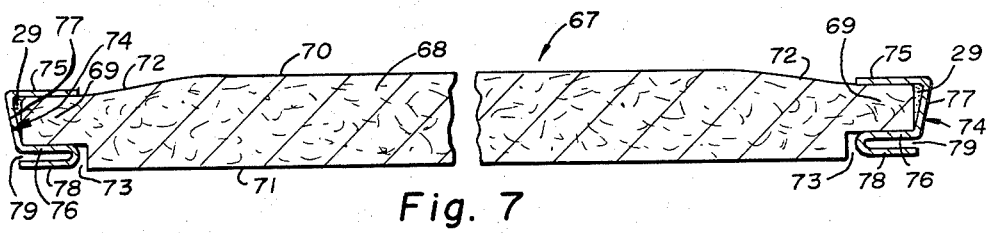
FIG. 7 is a cross-sectional view which shows the steel edged panel illustrated in FIG. 6 wherein steel facing is not provided.

Turning now to FIG. 7, the steel edged panel 67 of FIG. 6 is shown in detail. Steel edged panel 67 has body portion 68 with marginal edges 69, front face 70, and back face 71. Taper 72 is provided on front face 70 adjacent opposite marginal edges 69. On the back face 71 a notch 73 is provided adjacent opposite marginal edges 69 at a depth no greater than one-half the thickness of body portion 68. Body portion 68 desirably has a thickness of about $\frac{5}{8}$ inches. Steel edging 74 caps marginal edges 69. Steel edging 74 is disclosed as having a channel-shape with front flange 75, back flange 76 and web portion 77 integrally connecting front flange 75 to back flange 76. Web portion 77 is adapted to contact marginal edges 69. Back flange 76 terminates in a return flange 78 providing slot 79 therebetween. Slot 79 is disposed along notch 73. Slot 79 is adapted to engage to the engageable flange portions of conventional flanged stud 61 and releasably locking stud 63.

With reference to FIG. 6, releasably locking stud 63 permits steel edged panel 67, as shown, to be fully accessible by permitting removable member 65 to resiliently disengage with remaining portion 66 without damage thereto. Accessibility is desirable for attaining ease of entry to the hollow portion betwen the panels of wall partition assembly 60. The depth of notch 73 is provided most desirably no greater than one-half the thickness of body portion 68 but may be varied to position slot 79 at other depths as may be required.

Referring to FIG. 7, most desirably, the return flange 78 of steel edging 74 is in substantially coplanar relationship with back face 71. Additionally, front flange 75 contacts taper 22 and web portion 77 contacts marginal edge 69. Thereby, damage to the marginal edges 69 is minimized and this preferred conformation also facilitates ease of stacking during storage, shipping and handling procedures.

With additional reference to FIG. 7, bonding adhesive 29 is optionally located between steel edging 74 and marginal edges 69 for securement therebetween.

Figure 8:
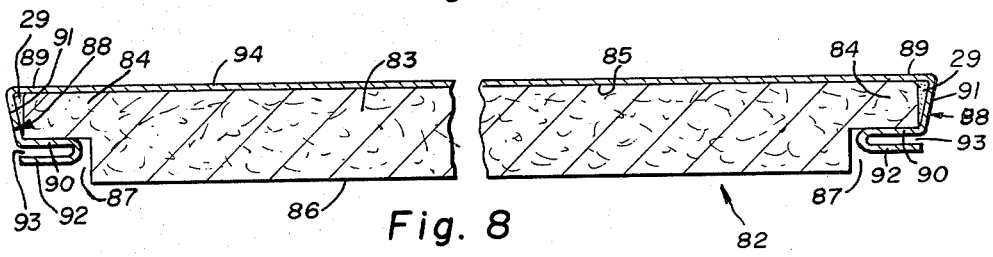
FIG. 8 is a cross-sectional view which shows the steel edged panel illustrated in FIG. 6 wherein a steel facing is provided.

In greater detail, FIG. 8 depicts steel edged panel 82 of FIG. 6. Steel edged panel 82 has body portion 83 with opposite marginal edges 84, front face 84, and back face 86. In this alternative embodiment there is no tapering adjacent the marginal edges 84 at front face 85. A notch 87 is provided on back face 86 adjacent both marginal edges 84. The depth of notch 87 is provided at no greater than one-half the thickness of body portion 83. Preferably, body portion 83 has a thickness of about $\frac{5}{8}$ inches. Capping marginal edges 84, steel edging 88 is provided and is adapted to contact marginal edges 84. Steel edging 88 is provided in conformance with the invention in a generally channel-shape. Steel edging 88 comprises a front flange 89, a back flange 90, and a web portion 91 integrally connecting front flange 89 with back flange 90. Back flange 90 terminates in a return flange 92 providing a slot 93 therebetween.

As shown in FIG. 8, slot 93 is disposed along notch 87. With reference to FIG. 6, slot 93 is provided in aligned registration with kerf 81 of conventionally kerfed edge panel 80. This adaptability of steel edged panel 82 with conventional wall partition assembly elements show one manner in which this invention can be coordinated with existing systems.

With reference to both of FIGS. 6 and 8, at marginal edge 84 of steel edged panel 82, adjacent releasably locking stud 63, the removable and accessible advantages of this invention are illustrated. Slot 93 is provided for adaptable engagement with T-shaped engageable edge 64. Accessibility is provided by removable member 65 which is resiliently engaged to remaining portion 66. Disconnection is simply accomplished by pulling steel edged panel 82 outwardly. No destruction or damage to steel edge panel 82 will be suffered because of this releasing lockability. Reengagement is accomplished by pushing steel edged panel 82 until removable member 65 resiliently engages remaining portion 66.

In providing notch 87 on back face 86, it is noted that its depth may be different in accordance with this invention but desirably will not be provided at any depth greater than one-half the thickness of body portion 83. By allowing the notch 87 to be varied in depth, versatility is obtained in the location of the slot 93 as particular desirable depths of engagement are required.

Steel edged panel 82, as shown in FIG. 8, is additionally provided with steel facing 94. Sheet facing 94 integrally connects opposing front flanges 89 of steel edging 88. Steel facing 94 desirably resides in coplanar relationship with front flanges 89 to thereby provide a planar exterior surface to steel edged panel 82. Steel edging 88 may optionally be secured by a bonding adhesive 29 between it and marginal edge 84. Moreover, steel facing 94 may be provided with optional additional securement by placing bonding adhesive 29 between it and the front face 85.

In FIGS. 6–8, the web portions of the steel edgings are preferably angled away from the panel edges inclining outwardly from the notches to front face. As seen by web portions 77 and 91, a recess for bonding adhesive 29 is thereby created. Additionally, the angled web portions also ensure a snug contact between panel front faces and steel edging front flanges; and, ensure snug contact between panel front faces and steel facing, if provided.

The steel edged panels as illustrated in FIGS. 1–7 are preferably comprised of gypsum having a depth of from about 5/16 inches to about $\frac{3}{4}$ inches, although as disclosed, the preferable depth is about $\frac{5}{8}$ inches. The termination of the steel facing is desirably provided at a distance of from about two inches to about six inches from the bottom of the panel adjacent the floor. The steel edged panels as provided in conformance with this invention and illustrated in the Figures, preferably have a width of from about 24inches to about 48 inches.

In the preferred alternative embodiments wherein no steel facing is provided, it is desirable that the front faces of the steel edged panels be vinyl laminated, or painted on a conventional manner in the field, to provide a desirable aesthetic appearance. When the steel facing is provided integrally connecting the front flanges of the steel edging, painting or coating is preferably provided on the exterior of the steel facing to provide an erasable writing surface. Some usable painting materials or coatings are: porcelain, baked enamel, vinyl, slate, chalkboard, and the like. This erasable type surface has wide utilization in providing a planar surface for classrooms, and the like, which can be inscribed with chalk, grease pencils, and the like, and later removed by simple washing or erasure techniques. Additionally, a magnetic tackboard surface is provided by the steel facing which may be utilized as a display panel or some similar use in conference rooms or classrooms as needed.

As disclosed, the steel edged panels in conformance with this invention provide full engagement with conventional studs and releasably locking studs having slot or kerf engageable flanged edges. No alterations to present day hollow wall partition stud configurations need to be made for utilization therewith. Moreover, as best seen in FIG. 2, a saving of material is obtained for stud 31. The web of the stud may be reduced in width, or a smaller stud used, because the location of slots 43 and 56 are at the back faces of the panels rather than at the center of the panel. In conventional kerfed edge gypsum wall panels, the T-shaped engaging edges of a stud is conventionally provided at the center of the marginal edge where the kerf is cut. This invention therefore permits a saving of material by positioning the slots closer together and requiring a smaller web. Additionally, because of the use of steel edging, improved structural rigidity and stability is provided over and above the conventional engagement between steel studs and kerfed gypsum panels.

As described, the steel edging has no above-face protuberances and provides a depth no greater than the panel body portion to thereby facilitate stacking of panels. Significant benefits of this invention are provided in that the tolerances of the stud-to-exposed-panel-face dimension can be greatly reduced over the present day saw kerfed gypsum panels. This distinct advantage would permit manufacturing straight parallel edges of panels thereby providing tight and flush joints upon installation. It would be clear to one skilled in the art that this invention provides greater resistance to impacts on a wall partition assembly, and, such is a critical feature when encountering federal specifications. The utilization of the steel edging in conformance with this invention provides advantages by eliminating saw kerfing. The invention also eliminates secondary fabricating steps such as shown with the use of back-up tabs in U.S. Pat. No. 3,986,313. The reduction of the sizes for the web and flanges of conventional steel studs is a substantial cost saving factor concomitantly provided by this novel invention.

The preferred embodiment disclosed herein, with preferred alternative conformations as disclosed, is presently considered to be the preferred form of the invention but changes and modifications may be made therein, and it is intended that the claims appended hereto shall cover such changes as found within the scope of this invention.

What is claimed is:

1. A steel edged gypsum wall panel engageable by flanged studs, said panel having substantially flush planar front and back surfaces and comprising:

a body portion of from about 5/16 inches to about $\frac{3}{4}$ inches thick having; front and back faces, and opposite marginal side edges, said front and back faces both having reduced portions adjacent said marginal side edges;

steel edges having a channel shape and comprising; a front flange, a back flange, a web portion integrally connecting said flanges and adapted to contact said marginal edge, wherein said back flange terminates in a return flange providing an engageable slot therebetween and, wherein at each steel edge said front flanges and return flanges are spaced apart a distance no greater than the distance between said front flush planar surface and said back flush planar surface wherein said back flanges contact said reduced portions adjacent said marginal side edges.

2. A steel edged gypsum wall panel as claimed in claim 1 wherein the body portion is tapered adjacent both marginal side edges on both front and back faces to provide said reduced portions and reduced thickness along said opposite marginal edges.

3. A steel edged gypsum wall panel as claimed in claim 2 wherein the steel edging channels cap said reduced marginal edges between the front and back flanges, said steel edges have a depth substantially equal to the thickness of the body portion whereby the return flanges are substantially coplanar with the back face of the body portion and said back flanges contact the tapered portions on the back face of the body portion.

4. A steel edged gypsum wall panel as claimed in claim 3 wherein the web portions of the steel edging angles outwardly from the back face to the front face of the panel.

5. A steel edged gypsum wall panel as claimed in claim 3 wherein said front flanges contact the tapered portions of the front face of the body portion and a bonding adhesive is disposed between said steel edging and body portion marginal edges for securement therebetween, and disposed along both tapered portions of the front face of the body portion sufficient to fill the tapers and provide the flush panel front surfaces being substantially coplanar with the front face of the body portion.

6. A steel edged gypsum wall panel as claimed in claim 3 wherein a sheet steel member integrally connects the front flanges of said opposite steel edging, said sheet steel member lying in generally coplanar relationship with said front flanges thereby providing a flush planar steel facing front surface to said panel.

7. A steel edged gypsum wall panel as claimed in claim 6 wherein a bonding adhesive is disposed between said body portion marginal edges and steel edging, and between the body portion front face and steel facing, for securement therebetween.

8. A steel edged gypsum wall panel as claimed in claim 6 wherein the web portion of the steel edging angles outwardly from the back face to the front face of the panel.

9. A steel edged gypsum wall panel as claimed in claim 1 wherein the body portion is tapered on the front face adjacent said opposite marginal side edges and notched on the back face adjacent said opposite marginal side edges at a depth no greater than one-half the thickness of the body portion.

10. A steel edged gypsum wall panel as claimed in claim 9 wherein the steel edging channels at the opposite marginal edges have the engageable slots disposed along said notches, and said front flanges contacting the tapered portion of the front face of the body portion.

11. A steel edged gypsum wall panel as claimed in claim 10 wherein the web portions of the steel edging angle outwardly from the notches to the front face of the panel.

12. A steel edged gypsum wall panel as claimed in claim 10 wherein a bonding adhesive is disposed between said steel edging and body portion marginal edges for securement therebetween, and disposed along both tapered portions of the front face sufficient to fill the tapers and provide the flush planar front panel surface being substantially coplanar with the front face of the body portion.

13. A steel edged gypsum wall panel as claimed in claim 9 wherein a sheet steel member integrally connects the front flanges of said steel edging, said sheet steel member lying in generally coplanar relationship with said front flanges thereby providing a flush planar steel facing front surface to said panel and wherein said steel edges cap the marginal edges having said engageable slots disposed along sid notches at the back face.

14. A steel edged gypsum wall panel as claimed in claim 13 wherein the web portions of the steel edging angle outwardly from the notches to the front face of the panel.

15. A steel edged gypsum wall panel as claimed in claim 13 wherein a bonding adhesive is disposed between said body portion marginal edges and steel edging, and disposed between said body portion front face and steel facing, for securement therebetween.

16. A wall partition assembly comprising:

A. two parallel spaced apart rows of gypsum wall panels including at least one panel having steel edging, said steel edged panel having substantially flush planar front and back surfaces and comprising:

1. a body portion of from about 5/16 inches to about ¾ inches thick having front and back faces, and opposite marginal side edges, said front and back faces both reduced portions adjacent said marginal side edges; and 2. steel edging along the opposite marginal side edges, said edging having a channel shape and comprising a front flange, a back flange, and, a web portion integrally connecting said flanges, said web being adapted to contact said marginal side edges, said back flange terminating in a return flange providing a flange-engageable slot therebetween, wherein at each steel edge said front flanges and return flanges are spaced apart a distance no greater than the distance between said front flush planar surface and said back flush planar surface wherein said back flanges contact said reduced portions adjacent said marginal side edges, wherein remaining gypsum wall panels in the assembly have kerfed marginal side edges; and, B. a plurality of studs located at joints between adjacent panels, said studs comprising a body portion with opposite generally T-shaped engageable flanged edges wherein at least one stud engages said steel edged panel having a flanged edge supportively engaged within the flange-engageable slot.

17. A wall partition assembly as claimed in claim 16 wherein at least one stud engaging the steel edge panel has a removable portion which resiliently engages a remaining portion of the stud to form the generally T-shaped panel engaging edge thereby providing simple panel demountability to permit ease of access to the plenum between the parallel spaced-apart rows of panels.

18. A wall partition assembly as claimed in claime 16 wherein the body portion is tapered on the front face adjacent said opposite marginal side edges and notched on the back face adjacent said opposite marginal side edges at a depth no greater than one-half the thickness of the body portion, wherein a sheet steel member integrally connects the front flanges of said opposite steel edging, said sheet steel member lying in generally coplanar relationship with said front flanges thereby providing a flush planar steel facing front surface to said panel, and wherein said steel edges cap the marginal edges having said flange-engageable slots disposed along said notches at the back face; and, wherein a bonding adhesive is disposed between said body portion marginal edges and steel edging, and disposed between said body portion front face and steel facing, for rigid securement therebetween.

19. A wall partition assembly as claimed in claim 18 wherein the web portions of the steel edging angle outwardly from the notches to the front face of the panel.

20. A wall partition assembly as claimed in claim 16 wherein the body portion of the steel edged panel is tapered on the front face adjacent said opposite marginal side edges and notched on the back face adjacent said opposite marginal side edges at a depth no greater than one-half the thickness of the body portion; wherein said steel edging channels cap the marginal edges and have the engageable slots disposed along said notches, and said front flange contacting the tapered portions of the front face of the body portion; and, wherein a bonding adhesive is disposed between said steel edging and body portion marginal edges for securement therebetween, and disposed along both tapered portions of the front face sufficient to fill the tapers and provide a flush planar front panel surface being substantially coplanar with the front face of the body portion.

21. A wall partition assembly as claimed in claim 20 wherein the web portions of the steel edging angle outwardly from the notches to the front face of the panel.

22. A wall partition assembly as claimed in claim 16 wherein the body portion of the steel edged panel is tapered adjacent both marginal side edges on both front and back faces to provide said reduced portions and reduced thickness along said marginal edges.

23. A wall partition assembly as claimed in claim 22 wherein the steel edging channels cap said reduced marginal edges between the front and back flanges, said steel edges have a depth substantially equal to the thickness of the body portion whereby the return flanges are substantially coplanar with the back face of the body portion and said back flanges contact the tapered portions on the back face of the body portion, and wherein a bonding adhesive is disposed between said steel edging and body portion marginal edges for securement therebetween.

24. A wall partition assembly as claimed in claim 23 wherein the web portions of the steel edging angle outwardly from the back face to the front face of the panel.

25. A wall partition assembly as claimed in claim 23 wherein a sheet steel member integrally connects the front flanges of said opposite steel edging, said sheet steel member lying in generally coplanar relationship with said front flanges thereby providing a flush planar steel facing front surface to said panel.

26. A wall partition assembly as claimed in claim 25 wherein the web portions of the steel edging angle outwardly from the back face to the front face of the panel.

27. A wall partition assembly as claimed in claim 25 wherein a bonding adhesive is disposed between said steel facing and the front face of the body portion for securement therebetween.

* * * * *